US007549559B2

(12) United States Patent
Conroy et al.

(10) Patent No.: US 7,549,559 B2
(45) Date of Patent: Jun. 23, 2009

(54) DIRECTIONAL POUR SPOUT CONTAINER CAP

(75) Inventors: Leslee Ann Conroy, Cheswick, PA (US); James Lawrence Conroy, Cheswick, PA (US); William Patrick Conroy, Cheswick, PA (US)

(73) Assignee: Conroy Foods, Inc., Pittsburgh, PA (US)

( * ) Notice: Subject to any disclaimer, the term of this patent is extended or adjusted under 35 U.S.C. 154(b) by 493 days.

(21) Appl. No.: 11/187,118

(22) Filed: Jul. 22, 2005

(65) Prior Publication Data

US 2007/0017939 A1 Jan. 25, 2007

(51) Int. Cl.
*B65D 47/00* (2006.01)

(52) U.S. Cl. ..... 222/556; 222/206; 222/543; 222/562; 222/567; 215/235; 215/237; 220/254.3; 220/254.5; 220/744; 220/831; 220/832

(58) Field of Classification Search ..... 222/556, 222/206, 215, 420, 498, 543, 562, 566–568; 215/235, 237; 220/254.3, 290, 831–832, 220/254.5, 744
See application file for complete search history.

(56) References Cited

U.S. PATENT DOCUMENTS

| | | | | | |
|---|---|---|---|---|---|
| 925,870 | A | * | 6/1909 | Cowgill | 222/543 |
| 1,701,949 | A | * | 2/1929 | Davenport | 222/545 |
| 1,714,102 | A | * | 5/1929 | Neil | 222/556 |
| 1,793,394 | A | * | 2/1931 | Guenard | 222/556 |
| 1,985,587 | A | * | 12/1934 | Storrs, Jr. | 220/326 |
| 3,295,726 | A | * | 1/1967 | Hanson | 222/109 |
| 4,047,648 | A | * | 9/1977 | Croyle | 222/498 |
| 4,127,221 | A | * | 11/1978 | Vere | 222/153.02 |
| 4,193,519 | A | * | 3/1980 | Dubach et al. | 222/111 |
| 4,334,639 | A | * | 6/1982 | Gach | 222/153.14 |
| 4,460,103 | A | * | 7/1984 | Rama et al. | 220/254.3 |
| 4,533,068 | A | * | 8/1985 | Meierhoefer | 222/189.09 |
| 4,742,928 | A | * | 5/1988 | Braun | 215/235 |
| 4,898,295 | A | * | 2/1990 | Kim | 220/613 |
| 4,949,865 | A | * | 8/1990 | Turner | 220/713 |
| 4,974,757 | A | * | 12/1990 | Brotz | 222/562 |
| 5,221,017 | A | * | 6/1993 | Cistone et al. | 215/235 |
| 5,246,150 | A | * | 9/1993 | Delia | 222/498 |
| 5,271,536 | A | * | 12/1993 | Wilson | 222/498 |

(Continued)

*Primary Examiner*—Kevin P Shaver
*Assistant Examiner*—Andrew P Bainbridge
(74) *Attorney, Agent, or Firm*—Kevin J. Garber

(57) ABSTRACT

Resealable caps and tops for directional pour spout containers currently available for liquid and semi-solid products are either a spout and cap design, in which the tip is cut off to pour or squeeze out the container contents, or a non-spout, hinged top-and-bottom design, which defines a flat surface with an opening. These designs have many limitations. For example, the closure portion of a conventional spout closure can become detached, leading to production line delays, lost tips in transit, product recall at the store level, loss of shelf life and potential chocking hazards to children and pets. The non-spout hinged, top-and-bottom design does not offer the directional dispensing capabilities. This invention addresses the shortcomings of conventional caps and tops by providing a one-piece directional pour spout container cap in which the base has an upwardly directed spout and a hinged flip top cap is attached to the spout. The flip top cap flips open and locks in place to permit dispensing, and then can be closed to reseal the container and preserve product integrity.

15 Claims, 3 Drawing Sheets

U.S. PATENT DOCUMENTS 5,297,697 A * 3/1994 Boring ..... 222/83
5,490,609 A * 2/1996 Lane et al. ..... 220/712
5,647,498 A * 7/1997 Kaneko ..... 220/263
5,769,253 A * 6/1998 Gross ..... 215/237
5,839,601 A * 11/1998 Van Melle ..... 220/712
5,944,228 A * 8/1999 Gray ..... 222/153.01
6,050,434 A * 4/2000 McNab ..... 215/235
6,152,320 A * 11/2000 Hierzer et al. ..... 220/838
6,357,634 B1 * 3/2002 Evans et al. ..... 222/525
6,612,456 B1 * 9/2003 Hundley et al. ..... 222/254.3
6,689,279 B1 * 2/2004 Train ..... 210/800
6,732,873 B2 * 5/2004 Bried et al. ..... 215/235
6,874,649 B2 * 4/2005 Clarke et al. ..... 220/254.3
6,926,179 B2 * 8/2005 Wagner et al. ..... 222/481.5
7,044,317 B2 * 5/2006 Smith et al. ..... 215/235
7,128,227 B2 * 10/2006 Skillin et al. ..... 215/235
2003/0116568 A1 * 6/2003 Clarke et al. ..... 220/254.3
2003/0189065 A1 * 10/2003 Stull et al. ..... 222/212
2004/0050883 A1 * 3/2004 Wagner et al. ..... 222/484
2005/0045669 A1 * 3/2005 Thunberg et al. ..... 222/556
2007/0017939 A1 * 1/2007 Conroy et al. ..... 222/556
2007/0138124 A1 * 6/2007 Skillin ..... 215/235
2008/0035681 A1 * 2/2008 Skillin ..... 222/556

* cited by examiner

DIRECTIONAL POUR SPOUT CONTAINER CAP

TECHNICAL FIELD

This invention is a pour spout, resealable container cap that allows the directional pouring of liquid and semi-solid contents from a container. The container cap is designed to streamline the filling, handling and packaging of the container during production, and it provides the consumer with a safer product container which is easier to open, close, seal, use and reuse.

BACKGROUND OF THE INVENTION

Many types of containers available in the marketplace are designed to permit the directional pouring of liquid and semi-solid contents from the containers. These containers contain a wide variety of products, from industrial products (such as caulking compounds, lubricants and adhesives) to pharmaceuticals and cosmetics (such as ointments, creams, and toothpaste) to food products and bottling (such as condiments, sauces and bottled water). The containers often have an elongated spout that allows the user to apply the product more or less precisely to the desired spot of application.

There are also many types of caps or tops available for use with directional pour containers. It is often desired to have a resealable cap to preserve the integrity or freshness of the contained product, particularly for products whose chemical or physical properties may change upon exposure to air after opening (e.g., caulking compound) and for foodstuffs that must be kept closed to maintain freshness and avoid spoliation (e.g., sauces and condiments). It is often further desired to have the cap physically attached to the container to avoid losing the cap.

Resealable, directional-pour caps and tops currently available in the industry are generally of a two-piece design comprising a lid and a cap. The lid, which is also the spout, is closed off at the top. The cap piece is placed over the spout tip. To access the product, the consumer must cut the spout tip with scissors or a knife. Caulking compound tubes are typical of this design. Once the spout tip is cut off, the removable cap portion of the bottle top must be retained separately throughout the life of the product to reseal the container. Product in an unsealed container loses its freshness more rapidly that the same product in a sealed bottle. If the cap is lost, the product is vulnerable to being spilled. A lost cap also presents a potential choking hazard in the consumer's home.

Two-piece bottle caps also present problems during manufacturing. The closure portion of the cap can become separated from the body portion of the cap when product containers are filled and packaged, thereby causing in-line production delays and decreased packing productivity. Closure portions of caps that are lost during transport or while on display in stores result in less salable inventory for the retailer.

One-piece caps are also available in the market. In these designs, the top part of the cap lifts from the bottom portion. There is an opening in the bottom portion through which the container contents can flow or be poured and a plug in the top portion which closes the opening when the cap is closed. A plastic ketchup bottle cap is typical of this design. The cap's top part is hinged to its bottom part to keep the two sections together. The hinge is located between and connects the container base and the container top; the hinge is not located directly on the spout. These types of caps are flat-surface caps, not directional pour spout caps. They do not permit the directional pouring of contents from the container.

SUMMARY OF THE INVENTION

This invention is a pour spout container cap comprising a base having an upwardly directed spout extending from the base and a retention ring defined about the circumference of the base, and a hinged flip top cap attached to the spout, the hinged flip top cap having a retention ring slot that interacts with the retention ring to lock the flip top cap in an open position. The design of the invention facilitates directional pouring from the container through a pour spout. The pour spout container cap has an integrated hinge mechanism in which the hinged flip top cap is attached to the spout, which allows the hinged flip top cap to be locked in the open position during dispensing. The design also keeps the flip top cap attached to the container during the product's life cycle, which helps to maintain product freshness. After dispensing, the flip top cap can be closed on the spout, thereby resealing the container after opening.

DETAILED DESCRIPTION OF THE INVENTION

Figure 1:
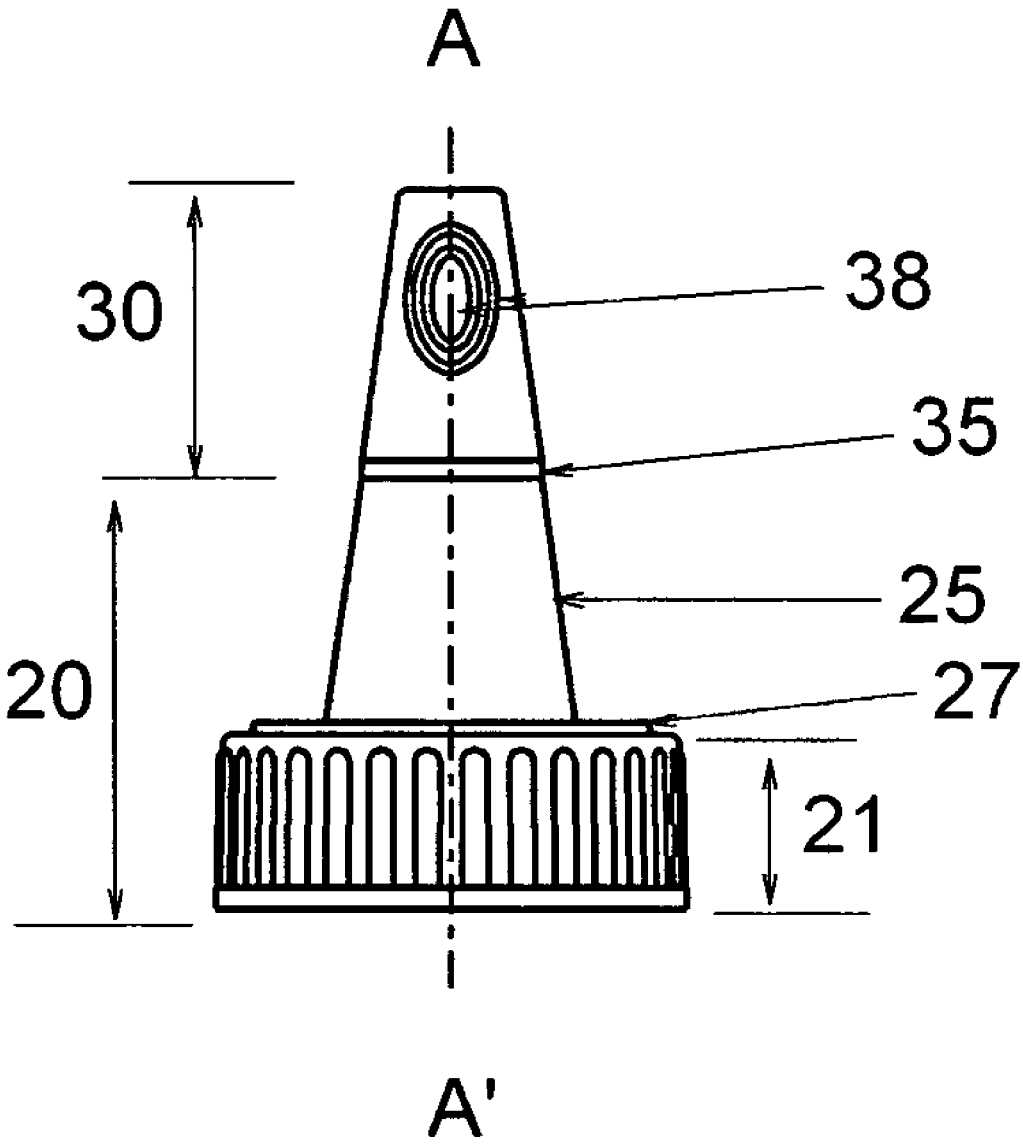
FIG. 1 is a side view illustrating a preferred embodiment of the pour spout container cap.
Figure 2:
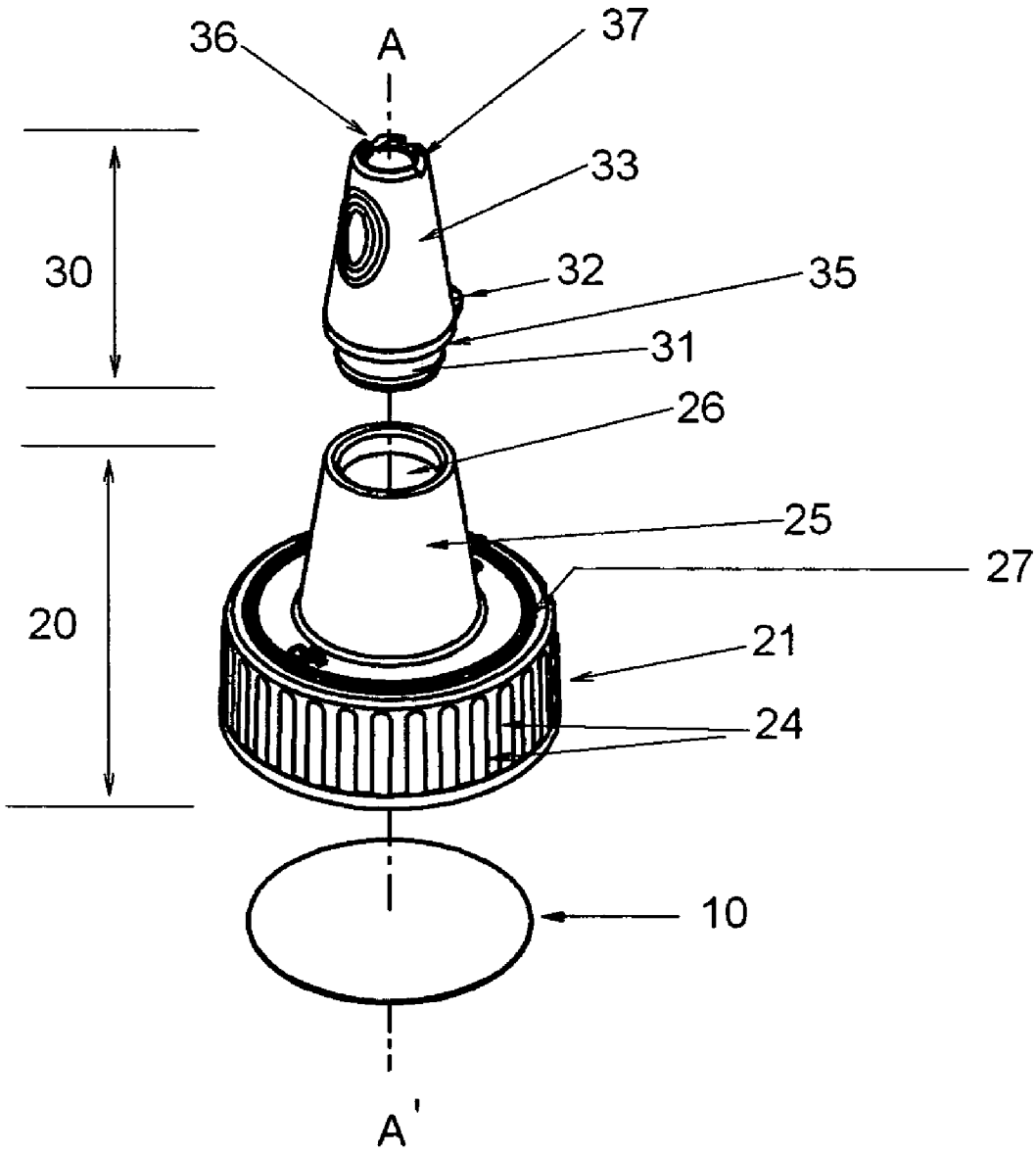
FIG. 2 is an expanded view of a preferred embodiment of the pour spout container cap, showing the component elements thereof.

Referring now to the drawings, and particularly to FIGS. 1 and 2, an embodiment of the pour spout container cap invention is shown generally and includes a base 20 and a spout cap 30. Base 20 articulates with the product container (not shown). Gasket 10 is interposed between the container and base 20 to prevent product from leaking or spilling from the container until the container is opened.

Figure 3:
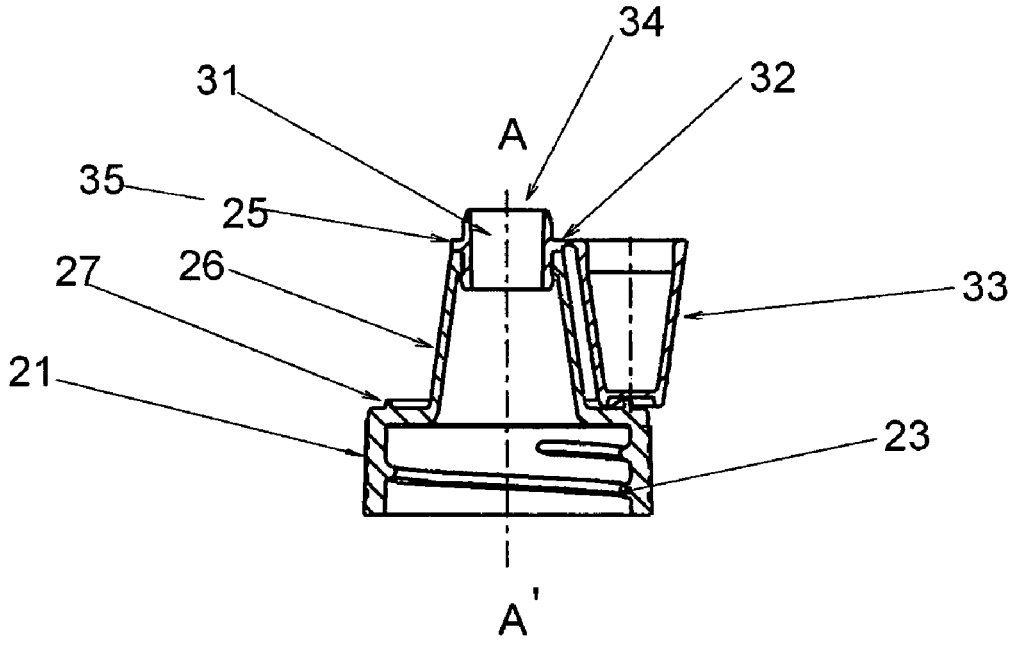
FIG. 3 is a cut-away side view of a preferred embodiment of the pour spout container cap, showing the integration of the elements thereof.

Base 20 has a body 21 and an upwardly extending hollow spout 25, the spout having spout orifice 26 defined in the center thereof to permit the passage of product through body 21 and spout 25. In a preferred embodiment of the invention for use as a cap for containers of pourable or squeezable sauces and condiments in the food industry, as shown in FIGS. 1 through 3, base 20 is molded from food grade polyethylene and spout 25 has a tapering conical shape which is directed away from, and narrows in the direction opposite to, the container. In this preferred embodiment, the angle of taper of spout 25 in relation to centerline A-A' through spout 25 and body 21 is 4 degrees, and the cut opening of spout 25 is parallel with the plane of the top of body 21. In other embodiments, for instance for use with containers of caulking compound, adhesives or lubricants, the spout can be cylindrical in shape. Alternatively, the conical taper of spout 25 and/or the cut opening of spout 25 can be made at any desired angle to accommodate the size of the desired bead of product application. Spout orifice 26 can be of any suitable diameter to permit the flow of product. In this preferred embodiment, body 21 has raised ribs 24 on the outside thereof and receiving threads 23 on the inside thereof which permit the cap to be gripped easily and screwed onto mating threads at the opening of the container. Other suitable means, such as snap-fits, of attaching the base 20 to a container are possible.

The body 21 of base 20 also has a rigid, raised retention ring 27 around the outside circumference of body 21. Retention ring 27 is elevated, with respect to the plane of the top of body 21, a suitable height to receive and hold retention ring slot 36 of hinged flip top cap 33, thereby articulating hinged flip top cap 33 to the body 21 of base 20 when the cap is open. This articulation of retention ring 27 to retention ring slot 36 serves to lock the hinged flip top cap 33 to base 20 in the open position during dispensing. In the preferred embodiment of the invention for use as a cap for containers of pourable or squeezable sauces and condiments, the elevation height of retention ring 27 is 1.4 mm above the top of body 21.

Hinged flip top cap 33 is attached to spout 25 of base 20. It is this design that facilitates the locking of hinged flip top cap 33 in the open position to allow for directional pouring, while keeping hinged flip top cap 33 attached to the pour spout container cap. Hinged flip top cap 33 can be attached to spout 25 by any suitable means, including by attaching hinged flip top cap 33 directly the wall of spout 25. The design of attaching a hinged flip top cap to the vertical wall of the spout, rather than hinging a cap to a base as is done with current one-piece flat-surface caps, is one novel feature of the invention. The closure of the spout opening thus becomes free standing; no additional support is needed to attach the closure to the base of the cap.

In the preferred embodiment illustrated herein, hinged flip top cap 33 has the matching conical shape of spout 25 and is attached to spout 25 by means of an insert body 31. As shown in FIG. 2, spout cap 30 has insert body 31, hinged flip top cap 33, and cap hinge 32 which movably connects insert body 31 with hinged flip top cap 33. Insert body 31 has a tapering, hollow conical shape, having cap orifice 34 defined in the center thereof and mid-rib 35 raised around the approximate center of the outside of insert body 31. Insert body 31 fits into spout 25 along center line A-A', as shown in FIG. 3, so that cap orifice 34 aligns with spout orifice 26 and thereby allowing the flow of product through the cap. In the preferred embodiment of the invention for use in the food industry, insert body 31 and spout 25 are molded of food grade polypropylene. Insert body 31 is pressure-fitted into spout orifice 26, and mid-rib 35 seats itself against top of spout 25 to prevent insert body 31 from falling all the way into spout 25. This articulation creates a one-piece pour spout container cap. Once properly seated inside spout 25, insert body 31 is held securely in place and will withstand the upwardly directed pressure against it caused by pouring or squeezing product from the container through the cap. Insert body 31 can also be cylindrical in shape if spout 25 is also made to be cylindrical rather than conical in shape.

As described above, hinged flip top cap 33 is connected to insert body 31 by means of cap hinge 32. Cap hinge 32 is formed by a slight extension of mid-rib 35 at any suitable point on spout cap 30. By formulating the cap from any suitably resilient plastic or similar material, such as food grade polypropylene in the preferred embodiment, cap hinge 32 functions to permit hinged flip top cap 33 to be easily opened, pushed back, away from cap orifice 34, and locked into an open position onto retention ring 27, thereby allowing product to be delivered from the container. After dispensing, hinged flip top cap 33 can be pushed forward, toward and over cap orifice 34, thereby resealing the cap and container when the delivery is finished. If desired, a cap directional indicator 38 may be molded into the hinged flip top cap 33 at a point opposite cap hinge 32, to give the user a visual reference point as to where to press the hinged flip top cap 33 to open the cap.

At the end of hinged flip top cap 33 opposite insert body 31, there is a rigid raised cap ring 37 around the top of hinged flip top cap 33. Cap ring 37 is elevated, with respect to the plane of hinged flip top cap 33, a suitable height within which to cut perpendicular retention ring slot 36 deep enough to articulate with retention ring 27 of body 21 of base 20. In the preferred embodiment described herein, the depth of retention ring slot 36 is 1.4 mm to match the height of retention ring 27. Thus, when hinged flip top cap 33 is pushed open, hinged flip top cap 33 pivots downward on cap hinge 32 and becomes inverted with respect to spout 25. Retention ring slot 36 fits into retention ring 27, thereby securing hinged flip top cap 33 to the cap by keeping hinged flip top cap 33 out of the way of the product when it is being poured or squeezed from the container. When the user has finished applying the product, he or she simply lifts retention ring slot 36 out of retention ring 27 and pivots hinged flip top cap 33 upward on cap hinge 32 to seat hinged flip top cap 33 onto mid-rib 35, thereby resealing the cap and container. In this preferred embodiment, spout cap 30 and base 20 are molded of sufficiently pliable sturdy plastic to allow the opening and closing of the cap on the container.

A preferred embodiment of the invention is for use as a cap for containers of pourable or squeezable sauces and condiments. In this embodiment, the inside diameter of base 20 is 28 mm and the outside diameter of base 20 is 33 mm. The height of base 20 is 12.3 mm and the combined height of base 20 and spout cap 30 is 50.8 mm. The diameter of cap orifice 34 is 6.4 mm. Spout 25 and hinged flip top cap 33 are conical in shape. The cut opening of cap orifice 34 and spout orifice 26 are parallel to the plane of base 20. However, the diameter and angle of the openings of cap orifice 34 and spout orifice 26 can be of any suitable size to pour or squeeze the desired width or angle of product bead from the container.

The invention described herein is not limited to the preferred embodiment described above. Many other embodiments of the invention are possible.

We claim:

1. A pour spout container cap comprising a base having an upwardly directed spout extending from the base and a retention ring defined about the circumference of the base, and a pin-free hinged flip top cap attached to the spout, the hinged flip top cap having a retention ring slot that interacts with the retention ring to firmly lock the flip top cap in an open position when inverted onto any point about the retention ring.

2. A pour spout container cap as specified in claim 1, wherein the spout and the hinged flip top cap are conical in shape.

3. A pour spout container cap as specified in claim 2, wherein the conical spout and the conical hinged flip top cap taper away from the base at an angle of 4 degrees from a center line through the spout and the hinged flip top cap.

4. A pour spout container cap as specified in claim 1, wherein the base is hollow.

5. A pour spout container cap as specified in claim 1, wherein the base contains receiving threads for securing the base onto a container.

6. A pour spout container cap as specified in claim 1, wherein the depth of the retention ring slot is equal to the height of the retention ring.

7. A pour spout container cap as specified in claim 1, wherein the hinged flip top cap is attached to an insert body and the insert body is fitted inside the spout for the hinged flip top cap to attach at any point about the circumference of the base.

8. A pour spout container cap comprising a base having an upwardly directed conical spout extending from the base and a retention ring defined about the circumference of the base, a hollow insert body fitted inside the spout, and a conical, hinged flip top cap attached to the insert body, the hinged flip top cap having a retention ring slot that interacts with the retention ring to lock the flip top cap in an open position when inverted onto any point about the retention ring.

9. A pour spout container cap as specified in claim 8, wherein the flip top cap comprises a living hinge.

10. A pour spout container cap as specified in claim 8, wherein the retention ring firmly locks the flip top cap in the open position.

11. A pour spout container cap as specified in claim 8, wherein the flip top cap can be unlocked for resealing.

12. A pour spout container cap as specified in claim 11, wherein the flip top cap can be repeatedly locked and unlocked.

13. A pour spout container cap comprising a base having an upwardly directed spout extending from the base and a retention ring defined about the circumference of the base, and a pin-free hinged flip top cap attached to the spout, the hinged flip top cap having a retention ring slot that interacts with the retention ring to firmly lock the flip top cap in an open position when inverted onto any point about the retention ring and to unlock the flip top cap from the retention ring when delivery through the container cap is finished.

14. A pour spout container cap as specified in claim 13, wherein the flip top cap can be repeatedly locked and unlocked.

15. A pour spout container cap as specified in claim 13, wherein the spout and the hinged flip top cap are conical in shape.

* * * * *